US012687347B2

(12) United States Patent
Shetty

(10) Patent No.: US 12,687,347 B2
(45) Date of Patent: Jul. 21, 2026

(54) HEAT DISSIPATING ELEMENT FOR RADIATOR AND METHOD OF MANUFACTURING THEREFOR

(71) Applicant: TTP TECHNOLOGIES PRIVATE LIMITED, Bangalore (IN)

(72) Inventor: Mohandas D Shetty, Bangalore (IN)

(73) Assignee: TTP TECHNOLOGIES PRIVATE LIMITED, Bangalore (IN)

( * ) Notice: Subject to any disclaimer, the term of this patent is extended or adjusted under 35 U.S.C. 154(b) by 132 days.

(21) Appl. No.: 18/357,968

(22) Filed: Jul. 24, 2023

(65) Prior Publication Data

US 2024/0035755 A1 Feb. 1, 2024

(30) Foreign Application Priority Data

Jul. 26, 2022 (IN) ..... 202241042707

(51) Int. Cl.
*F28F 3/12* (2006.01)
*F28D 1/03* (2006.01)
(Continued)

(52) U.S. Cl.
CPC ..... *F28F 3/025* (2013.01); *F28D 1/0316* (2013.01); *F28F 3/12* (2013.01); *F28F 2009/0292* (2013.01)

(58) Field of Classification Search
CPC . F28D 1/0316; F28F 3/025; F28F 3/12; F28F 21/08; F28F 21/083; F28F 2009/0292; H01F 27/12
See application file for complete search history.

(56) References Cited

U.S. PATENT DOCUMENTS 4,549,603 A 10/1985 Shirai et al.
2011/0043999 A1* 2/2011 Johnston ..... H01F 27/40 361/699
(Continued)

FOREIGN PATENT DOCUMENTS

CN 201199475 Y * 2/2009
CN 102034590 A 4/2011
(Continued)

OTHER PUBLICATIONS

Machine translation of CN 201199475 (Year: 2025).*
(Continued)

*Primary Examiner* — Eric S Ruppert
*Assistant Examiner* — Hans R Weiland
(74) *Attorney, Agent, or Firm* — INTELLECTUAL PROPERTY LAW GROUP LLP

(57) ABSTRACT

A heat dissipating element for a radiator for better thermal performance by dissipating more heat from high viscous oil filled transformer and a method of manufacturing therefor are disclosed. The heat dissipating element comprises a plurality of flutes defined in a body thereof, with a transverse section of each flute representing two trapezium mirrored to each other along a base. The heat dissipating element comprises an inlet port in a top portion of the body to receive the fluid and supply the fluid to each of the plurality of flutes, and an outlet port in a bottom portion of the body to collect the fluid from each of the plurality of flutes. The plurality of flutes are extending longitudinally downwards and diverging laterally outwards from the inlet port, extending longitudinally downwards in a middle portion of the body, and extending longitudinally downwards and converging laterally inwards towards the outlet port.

13 Claims, 7 Drawing Sheets

(51) Int. Cl.
*F28F 3/02* (2006.01)
*F28F 9/02* (2006.01)

(56) References Cited

U.S. PATENT DOCUMENTS

| | | | | |
|---|---|---|---|---|
| 2015/0213940 | A1* | 7/2015 | Miyamoto | H01F 27/12 336/58 |
| 2021/0166856 | A1* | 6/2021 | Bachinger | H01F 27/025 |

FOREIGN PATENT DOCUMENTS

| | | | | | |
|---|---|---|---|---|---|
| CN | 102360760 | A | | 2/2012 | |
| CN | 111525819 | A | * | 8/2020 | H01F 27/10 |
| EP | 0077575 | A1 | | 4/1983 | |
| EP | 3 028 286 | B1 | | 10/2017 | |
| WO | WO 2009/137892 | A1 | | 11/2009 | |

OTHER PUBLICATIONS

Extended European Search Report, dated Dec. 15, 2023 for corresponding European Patent Application No. 23186528.8 (8 pages).

* cited by examiner

HEAT DISSIPATING ELEMENT FOR RADIATOR AND METHOD OF MANUFACTURING THEREFOR

CROSS-REFERENCE TO RELATED APPLICATIONS

This application claims benefit of India patent application no. 202241042707, filed on Jul. 26, 2022, the disclosure of which is hereby incorporated by reference in its entirety for all purposes.

FIELD OF THE INVENTION

The present disclosure, generally, relates to a radiator for cooling a transformer, and particularly to a heat dissipating element of a radiator and a method of manufacturing the heat dissipating element.

BACKGROUND

The basic objective in any structural design is to provide a structure capable of resisting all the loads without failure during the intended life. Power transformers designed to distribute large amounts of power, such as substation and distribution class power transformers, may suffer due to overheat. For instance, if the cooling is compromised, the transformer temperature may rise above desired values. Such a rise in temperature may result in the outright failure of the power transformer and at a minimum will result in some damage and an accelerated loss of life. That is, over time excessive heating will reduce transformer life and lead to premature failure which will affect the ability of a utility company to supply uninterrupted supply of power to its customers and will cost the operating utility significant replacement costs.

Transformers generally include cooling systems to remove heat generated when large loads are applied to the transformers (i.e., when large currents are drawn from and through the transformer). Maintaining the transformer temperature below a critical value enables the transformer to handle a designated power capacity or to increase the power handling capability of the transformer. The cooling systems are designed to remove heat to help keep the transformer and its components below predetermined critical temperatures. Generally, the cooling system has the transformer contained within a liquid (e.g., oil) filled tank with or without oil pumps being used to circulate the fluid through radiators attached to the tank. The operation of the radiator is vital for the transformer to deliver its designated power capacity.

The radiators are also used in automobiles, generators, etc., but the design and the performance of the product varies and are meant for a specific application. That is, generally, the purpose of radiator is the same for various applications, be it transformers, automobiles, generators, etc., but the design and the performance of the product shall manifest its performance in the field of application and shall be an economical solution. Systems may suffer because of incorrect use of radiator design for oil cooling. In addition to the thermal performance, the radiator shall also be capable of withstanding the external forces like seismic, vibration, wind force, external force on the radiator due to the accumulation of ice-berg in the cold countries and the self-weight of radiator and the oil weight.

There are different design implementations of the radiator known in the art. The most common and widely used radiators include tubular type radiators. In a tubular-type radiator, an upper side which receives the heated oil from the transformer and a lower side which supplies back the oil to the transformer are connected by a series of tubes through which the oil passes. Air passes around the outside of the tubes, absorbing heat from the oil (or water) in passing. In some examples, fins are placed around the tubes to improve heat transfer. In such tubular-type radiators, tubes are welded to the top and lower sides which may lead to structural integrity concerns. The tubes being straight are generally disposed close to heat dissipating portion of the transformer and thus may have less exposure to cool air from the atmosphere. Thus, large capacity transformer requires the radiator to have a larger number of tubes, and further tubes of larger length, to achieve required thermal performance. Thus, the tubular-type radiators are not economical in practice for power transformer applications.

Moreover, the transformer industry is increasingly switching over to environmental friendly ester-based oil for transformers from mineral-based oil. Ester-based oil has come into the market with its major advantage of being bio-degradable. But one of the major limitations of the ester-based oil is its high viscosity. In actual scenario for high viscous oil, if the hydraulic dimensions of the tubes in the radiator are small, the frictional forces are more. If the hydraulic dimensions are large, radiator's manufacturers endure from manufacturing process limitation and transformers will endure from excess oil consumption. This becomes a major setback in the thermal performance of the tubular-type radiators.

The present disclosure has been made in view of such considerations, and it is an object of the present disclosure to provide a heat dissipating element for a radiator which overcomes the problems associated with the known designs, including structural concerns, and provide better cooling performance for the radiator.

SUMMARY

In an aspect, a heat dissipating element for a radiator is disclosed. The heat dissipating element comprises a body having a top portion, a bottom portion and a middle portion. The heat dissipating element further comprises a plurality of flutes defined in the body. Each of the plurality of flutes provides a continuous channel to allow for flow of a fluid therein. The heat dissipating element also comprises an inlet port provided at the top portion to receive the fluid and supply the fluid to each of the plurality of flutes, and an outlet port provided at the bottom portion to collect the fluid from each of the plurality of flutes. In the heat dissipating element, one or more of the plurality of flutes are extending longitudinally downwards and diverging laterally outwards from the inlet port in the top portion of the body, extending longitudinally downwards in the middle portion of the body, and extending longitudinally downwards and converging laterally inwards towards the outlet port in the bottom portion of the body.

In one or more embodiments, a cross-section of each one of the plurality of flutes is in the form of two trapeziums mirrored to each other along bases thereof.

In one or more embodiments, a sheet surface of the body between the plurality of flutes is corrugated.

In one or more embodiments, the plurality of flutes comprises nine number of flutes.

In one or more embodiments, the fluid comprises ester oil.

In another aspect, a radiator for cooling a device is disclosed. Herein, the device has a fluid flowing therethrough to extract heat therefrom. The radiator comprises a first collector pipe disposed in connection with the device to be cooled to receive the fluid therefrom. The radiator also comprises a second collector pipe disposed in connection with the device to be cooled to supply back the fluid thereto. The radiator further comprises one or more heat dissipating elements. Each of the one or more heat dissipating elements comprises a body having a top portion, a bottom portion and a middle portion; a plurality of flutes defined in the body, with each of the plurality of flutes providing a continuous channel to allow for flow of the fluid therein; an inlet port provided at the top portion in fluid communication with the first collector pipe to receive the fluid therefrom, and to supply the fluid to each of the plurality of flutes; and an outlet port provided at the bottom portion to collect the fluid from each of the plurality of flutes, and in fluid communication with the second collector pipe to supply the collected fluid thereto. In the heat dissipating element, one or more of the plurality of flutes are extending longitudinally downwards and diverging laterally outwards from the inlet port in the top portion of the body, extending longitudinally downwards in the middle portion of the body, and extending longitudinally downwards and converging laterally inwards towards the outlet port in the bottom portion of the body.

In one or more embodiments, a longitudinal length of each of the one or more heat dissipating elements is in a range of 500 mm up to 4500 mm.

In one or more embodiments, a number of the one or more heat dissipating elements varies from 1 to 45.

In one or more embodiments, a cross-section of each one of the plurality of flutes is in the form of two trapeziums mirrored to each other along bases thereof.

In one or more embodiments, a sheet surface of the body between the plurality of flutes is corrugated.

In one or more embodiments, the fluid comprises ester oil.

In yet another aspect, a method of manufacturing a heat dissipating element for a radiator is disclosed. The method comprises forming a first metal sheet to define a plurality of first open profiles extending along a longitudinal length thereof. The method further comprises forming a second metal sheet to define a plurality of second open profiles extending along a longitudinal length thereof, complementary to the plurality of predefined open profiles formed in the first metal sheet. The method further comprises joining the first metal sheet and the second metal sheet so as to form a body having a top portion, a bottom portion and a middle portion, and a plurality of flutes defined therein from the plurality of first open profiles and the plurality of second open profiles closing each other, with each of the plurality of flutes providing a continuous channel to allow for flow of a fluid therein. The method further comprises providing an inlet port at the top portion of the body to receive the fluid and supply the fluid to each of the plurality of flutes. The method further comprises providing an outlet port at the bottom portion of the body to collect the fluid from each of the plurality of flutes. Herein, one or more of the plurality of flutes are extending longitudinally downwards and diverging laterally outwards from the inlet port in the top portion of the body, extending longitudinally downwards in the middle portion of the body, and extending longitudinally downwards and converging laterally inwards towards the outlet port in the bottom portion of the body.

In one or more embodiments, each of the plurality of first open profiles and each of the plurality of second open profiles is in form of a trapezium opened at base thereof, and wherein a cross-section of each one of the plurality of flutes is in the form of two trapeziums mirrored to each other along the bases thereof.

In one or more embodiments, the plurality of first open profiles and the plurality of second open profiles are formed in the first metal sheet and the second metal sheet, respectively, using one or more of: rolling operation, stamping operation.

In one or more embodiments, the first metal sheet and the second metal sheet is made of at least one of CRCA IS 513 CR2 grade steel, CRCA IS 513 CR3 grade steel, CRCA IS 513 CR5 grade steel, and austenitic stainless grade steel.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

For a more complete understanding of example embodiments of the present disclosure, reference is now made to the following descriptions taken in connection with the accompanying drawings in which.

DETAILED DESCRIPTION

In the following description, for purposes of explanation, numerous specific details are set forth in order to provide a thorough understanding of the present disclosure. It will be apparent, however, to one skilled in the art that the present disclosure is not limited to these specific details.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Some portions of the detailed description that follows are presented and discussed in terms of a process or method. Although steps and sequencing thereof are disclosed in figures herein describing the operations of this method, such steps and sequencing are exemplary. Embodiments are well suited to performing various other steps or variations of the steps recited in the flowchart of the figure herein, and in a sequence other than that depicted and described herein.

Figure 1:
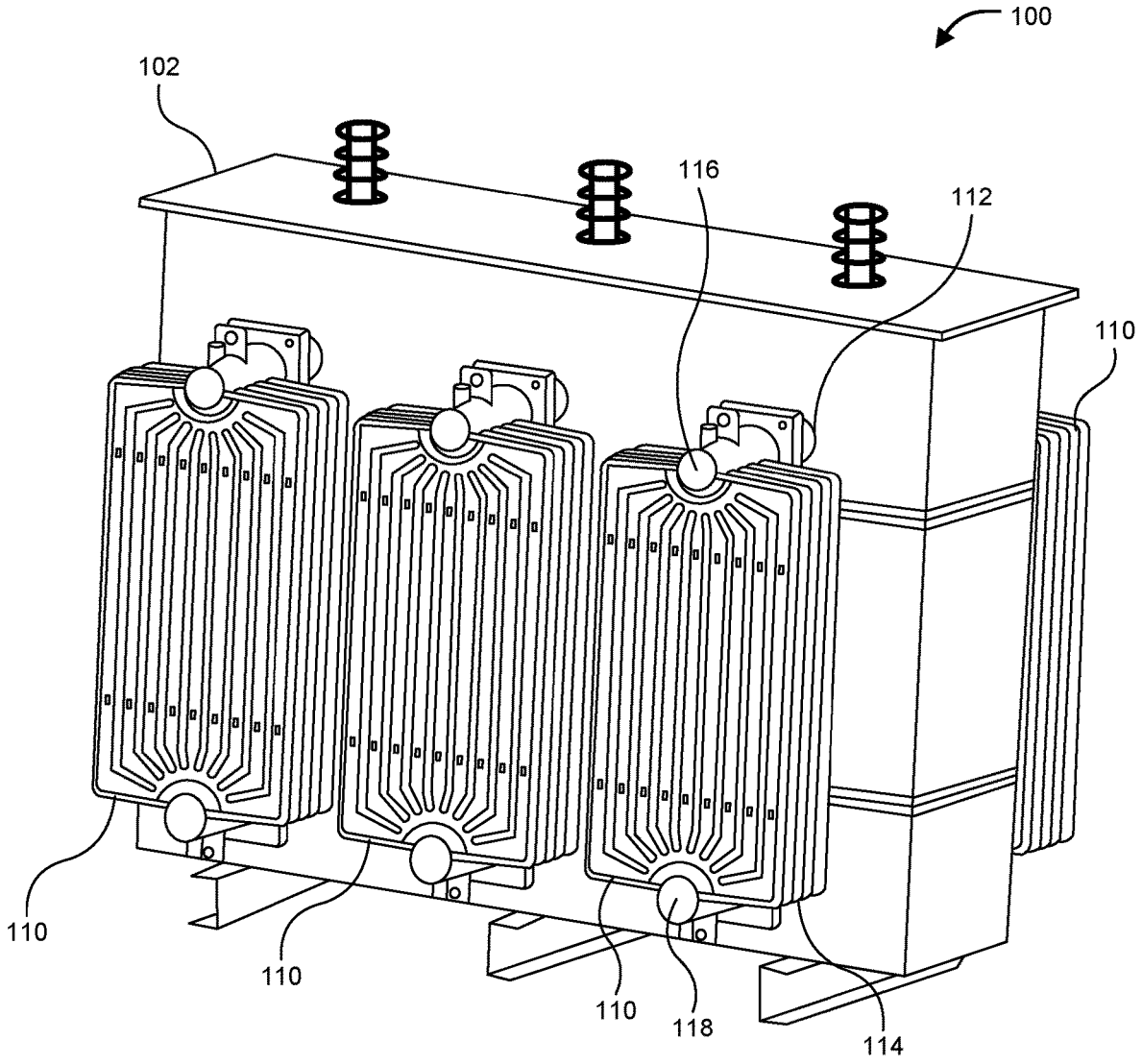
FIG. 1 illustrates a diagrammatic perspective view of a transformer device utilizing multiple radiators, in accordance with one or more exemplary embodiments of the present disclosure.

Referring to FIG. 1, illustrated is a diagrammatic perspective view of a device (represented by reference numeral 100) which needs to be cooled. In the illustrated embodiment of FIG. 1, the device 100 is a transformer device, with the two terms being interchangeably used hereinafter for the purposes of the present disclosure. However, it may be appreciated that the device 100 may be an automobile, a generator, or any similar device which may also be needed to be cooled (using radiator, as described later) without any limitations. As shown, the transformer device 100 includes a housing (as represented by reference numeral 102) which may enclose the actual power transformer (not visible). As is known in the art, the primary and secondary windings of the power transformer have some resistance. As current flows through the windings, heat is generated which is a function of the winding resistance multiplied by the square of the current. A considerable amount of heat may be generated by, and within, the power transformer, particularly when the load is increased and more current flows through the power transformer's primary and secondary windings.

The heat generated within the power transformer causes a rise in the temperature of the windings and in the space surrounding the windings and all around the power transformer. When the temperature rises above a certain level many problems are created. For example, the resistance of the (copper) transformer windings increases as a function of the temperature rise. The resistance increase causes a further increase in the heat being dissipated, for the same value of load current, and further decreases the efficiency of the transformer. With increased temperature, the power transformer may also be subjected to increased eddy current and other losses. The temperature rise may also cause unacceptable expansion (and subsequent contraction) of the wires. Also, the insulation of the windings and other components may be adversely affected. Temperatures above designed and desirable levels result in undesirable stresses being applied to the power transformer and or its components. This may cause irreversible damage to the power transformer and its associated components and at a minimum creates stresses causing a range of damages which decrease its life expectancy.

In the transformer device 100, the power transformer is cooled by immersing it in a fluid (e.g., oil, with the two terms being interchangeably used). For this purpose, the housing 102 is filled with the oil to extract heat from the power transformer. Now, this fluid needs to be transferred out of the housing 102 to be cooled and to be re-circulated back into the housing 102 to again be used for heat extraction from the power transformer. The transformer device 100 includes one or more radiators (represented by reference numeral 110) for the said purpose. The radiators 110 are heat exchangers used to transfer thermal energy from one medium to another for the purpose of cooling and/or heating, such as, in the present case, from the oil to the atmosphere. The radiators 110 usually provide a large amount of cooling surface to be in contact with large amounts of air so that it spreads through the oil to cool efficiently.

In the illustrated embodiment, the transformer device 100 is shown to include six radiators 110 (four being visible); however, it may be appreciated that the number of radiators 110 implemented for the transformer device 100 may depend on the rating of the power transformer thereof. There are different types and ratings of the transformer device 100 which may warrant as few as one radiator 110 or as many as tens of radiators 110. Further, it may be appreciated that arrangement of the radiators 110 in the illustration of FIG. 1 is exemplary only, and shall not be construed as limiting to the present disclosure. Generally, the radiators 110 may be arranged in the transformer device 100 in any suitable arrangement without departing from the spirit and the scope of the present disclosure.

As may be seen from FIG. 1, the transformer device 100 includes an outflow pipe 112, for each radiator 110, connecting the corresponding radiator 110 and the housing 102, which may allow to transfer the fluid from the inside of the housing 102 to the corresponding radiator 110. It may be contemplated that the transformer device 100 may include one or more pumps (not shown) to provide pumping action for said transfer of the fluid. Further, the transformer device 100 includes an inflow pipe (generally marked by reference numeral 114, not particularly visible in FIG. 1), for each radiator 110, connecting the corresponding radiator 110 and the housing 102, to receive the cooled fluid from the corresponding radiator 110 to be transferred back to the inside of the housing 102. Also, as shown in FIG. 1, each radiator 110 includes a first collector pipe 116 disposed in connection with the housing 102. In particular, the first collector pipe 116 is disposed in connection with the outflow pipe 112 to receive the fluid at the corresponding radiator 110 to be cooled from the inside of the housing 102. Also, each radiator 110 includes a second collector pipe 118 disposed in connection with the housing 102. In particular, the second collector pipe 118 is disposed in connection with the inflow pipe 114 to transfer the cooled fluid from the corresponding radiator 110 to the inside of the housing 102.

Figure 2A:
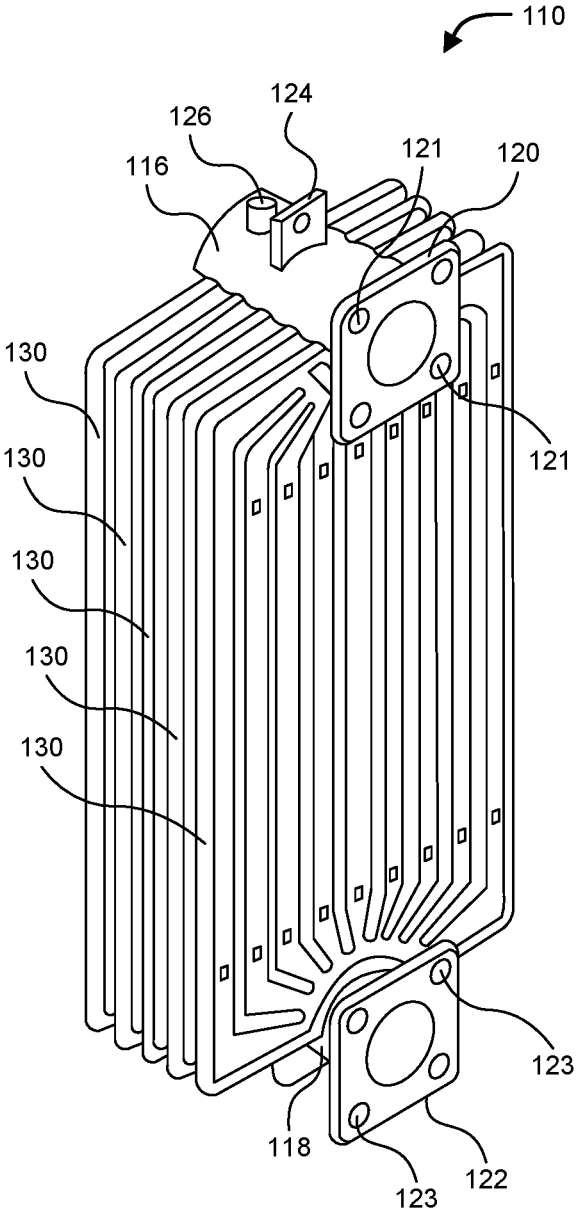
FIG. 2A illustrates a diagrammatic perspective view of the radiator, in accordance with one or more exemplary embodiments of the present disclosure.
Figure 2B:
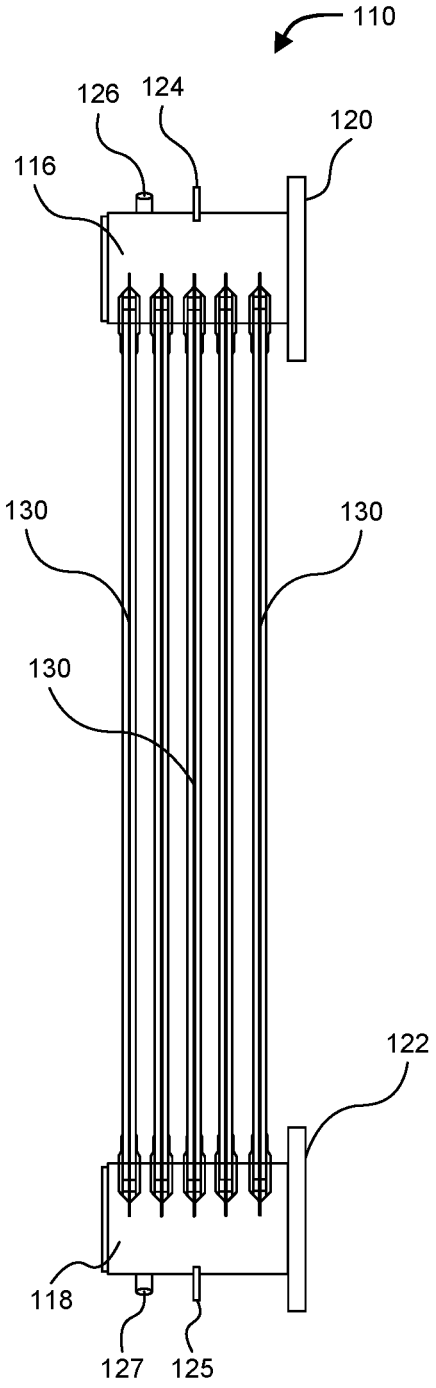
FIG. 2B illustrates a diagrammatic side planar view of the radiator, in accordance with one or more exemplary embodiments of the present disclosure.
Figure 3A:
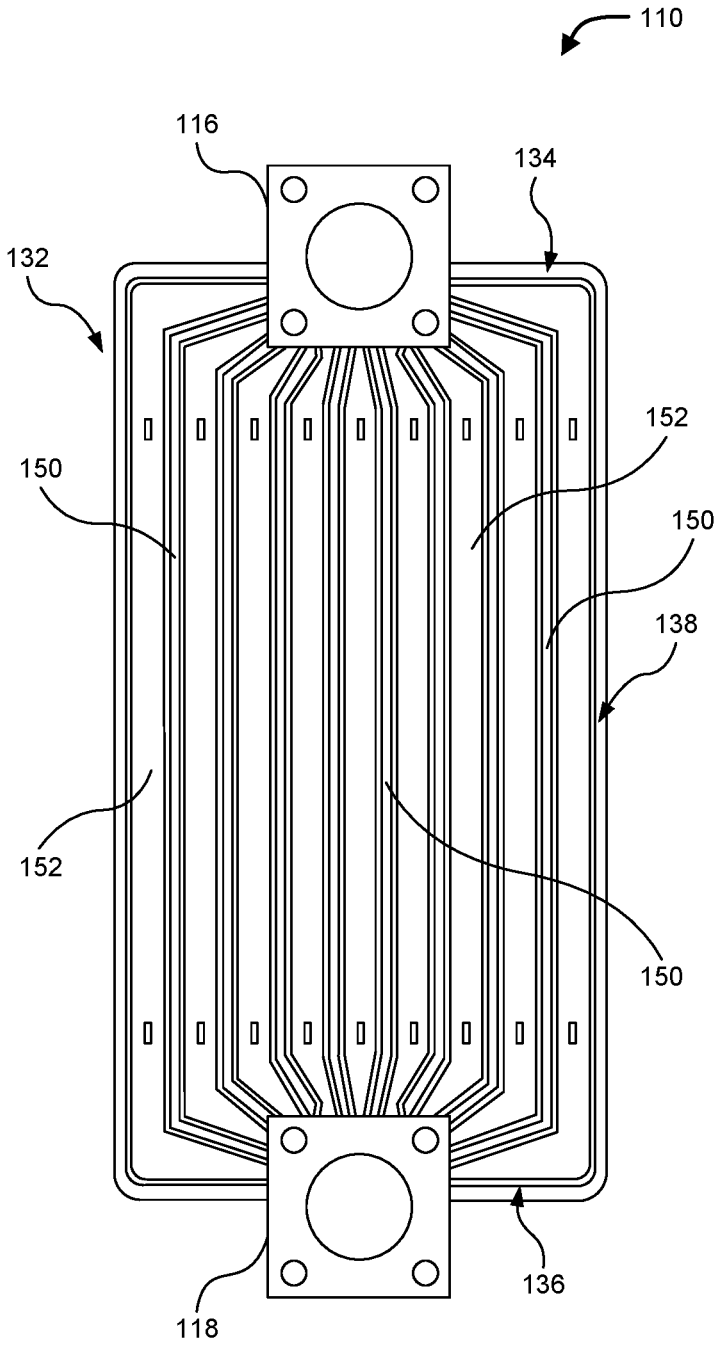
FIG. 3A illustrates a diagrammatic front planar view of a heat dissipating element of the radiator, in accordance with one or more exemplary embodiments of the present disclosure.
Figure 3B:
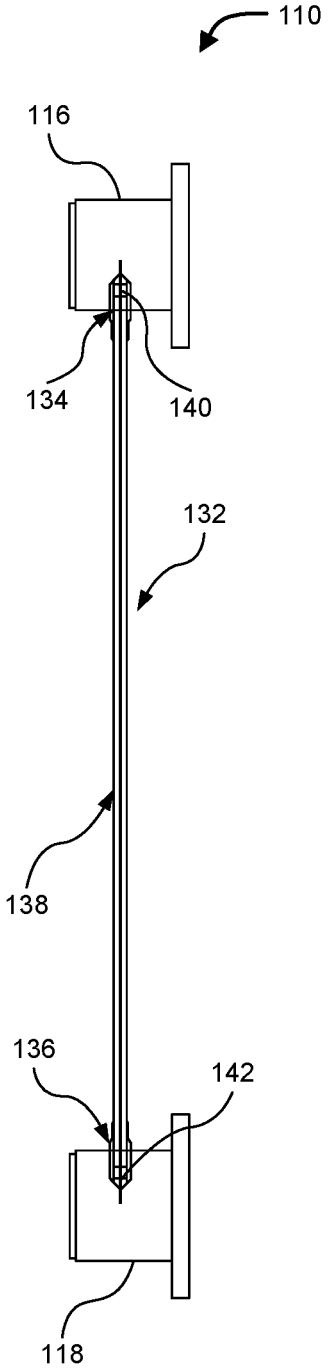
FIG. 3B illustrates a diagrammatic left side planar view of the heat dissipating element of the radiator, in accordance with one or more exemplary embodiments of the present disclosure.
Figure 3C:
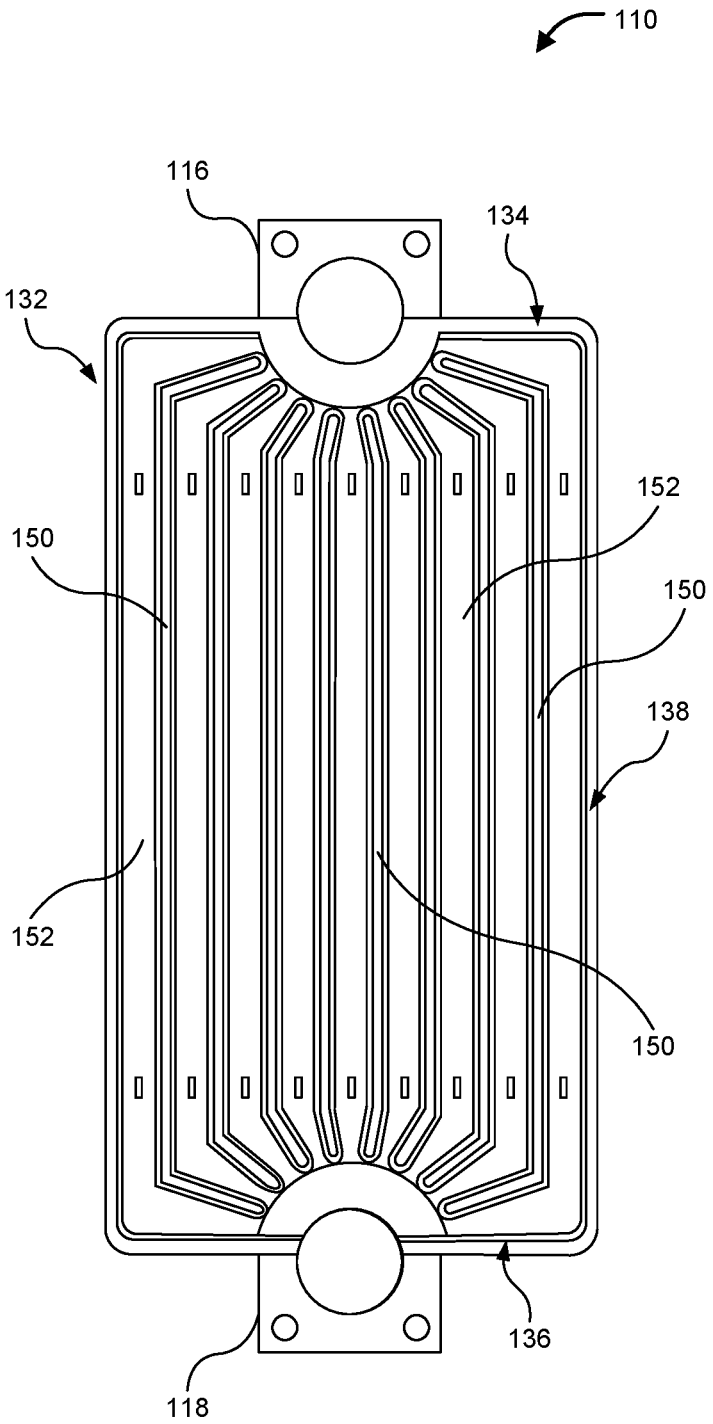
FIG. 3C illustrates a diagrammatic rear planar view of the heat dissipating element of the radiator, in accordance with one or more exemplary embodiments of the present disclosure.
Figure 3D:
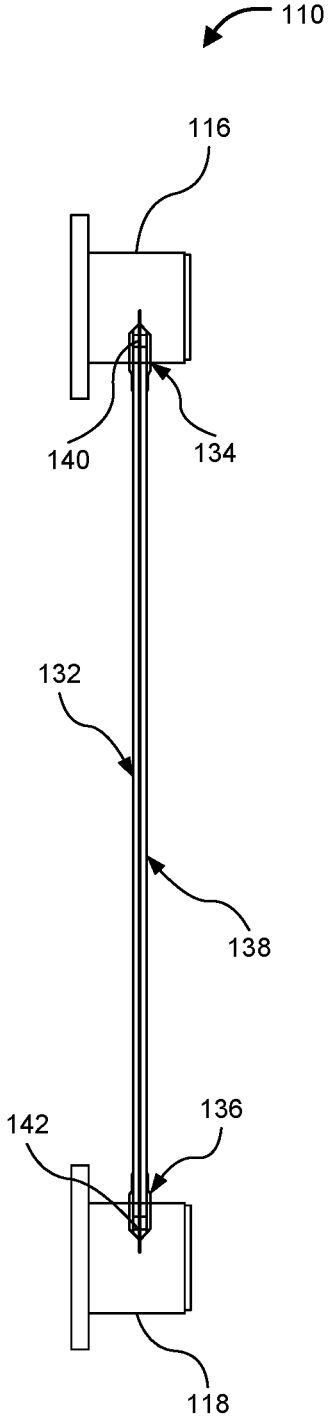
FIG. 3D illustrates a diagrammatic right side planar view of the heat dissipating element of the radiator, in accordance with one or more exemplary embodiments of the present disclosure.

Referring to FIGS. 2A and 2B in combination, as shown, the first collector pipe 116 of the radiator 110 includes a first flange 120 at end thereof to allow for connection with the outflow pipe 112 to receive the fluid at the corresponding radiator 110. For this purpose, the first flange 120 may be provided with apertures (represented by reference numeral 121). It may be contemplated that the outflow pipe 112 may also have a corresponding flange with apertures (not shown), to mate with the apertures 121 in the first flange 120 of the first collector pipe 116 by using fasteners or the like (not shown). Similarly, the second collector pipe 118 of the radiator 110 includes a second flange 122 at end thereof to allow for connection with the inflow pipe 114 to receive the fluid at the corresponding radiator 110. For this purpose, the second flange 122 may be provided with apertures (represented by reference numeral 123). It may be contemplated that the inflow pipe 114 may also have a corresponding flange with apertures (not shown), to mate with the apertures 123 in the second flange 122 of the second collector pipe 118 by using fasteners or the like (not shown).

Also, as shown in FIGS. 2A and 2B, the radiator 110 may include one or more lugs which may be used to lift the radiator 110. In an example, as shown, one of the lugs 124 may be provided on the first collector pipe 116 and another lug 125 may be provided on the second collector pipe 118. That said, it may be appreciated that one or more of the lugs 124, 125 may be provided on any other location on the radiator 110 suitable for bearing weight of the radiator 110 without any limitations. In an example, the lugs 124, 125 may be designed to couple with a lifting mechanism using a shackle and pin arrangement for the said purpose of lifting the radiator 110, as required. Further, the radiator 110 may include one or more plugs. In an example, as shown, one of the plugs 126 may be provided on the first collector pipe 116 and another plug 127 may be provided on the second collector pipe 118. The plugs 126, 127 are used to allow for releasing air and/or draining oil present in the radiator 110, via the first collector pipe 116 and the second collector pipe 118, such as, in case of need of emptying the radiator 110 for dismantling and/or transportation thereof.

Further, as shown in FIGS. 2A and 2B, the radiator 110 includes one or more heat dissipating elements 130. Herein, the heat dissipating elements 130 are in the form of fins exposed to the atmosphere. The heat dissipating elements 130 are configured to allow the oil to travel inside thereof, causing transfer of heat from the oil to the atmospheric air thereby. In the illustrated embodiments, the radiator 110 is shown to include five heat dissipating elements 130; however, it may be contemplated that the radiator 110 may include more or lesser number of heat dissipating elements 130 depending on the cooling requirement, which in turn may be based on the rating of the transformer device 100 or the like, without departing from the spirit and the scope of the present disclosure. In the present embodiments, the heat dissipating elements 130 are in the form of sheets with certain thicknesses at certain sections thereof (as discussed later in lot more detail). Also, as shown, the heat dissipating elements 130 are arranged parallel to each other in the radiator 110.

Referring now to FIGS. 3A-3D in combination, different views of one of the heat dissipating elements 130 are illustrated. In the illustrations of FIGS. 3A-3D, the heat dissipating element 130 is shown to be disposed between the first collector pipe 116 and the second collector pipe 118. The heat dissipating element 130 provides a body 132 having a top portion 134, a bottom portion 136 and a middle portion 138. The body 132 is extending between the first collector pipe 116 and the second collector pipe 118, with the top portion 134 being disposed within the first collector pipe 116 and the bottom portion 136 disposed within the second collector pipe 118, and the middle portion 138 being exposed to the atmosphere. Also, as shown, the heat dissipating element 130 includes an inlet port (generally marked by reference numeral 140) in fluid communication with the first collector pipe 116 to receive the fluid therefrom. Further, the heat dissipating element 130 includes an outlet port (generally marked by reference numeral 142) in fluid communication with the second collector pipe 118 to supply the collected fluid thereto.

Further, as shown, the heat dissipating element 130 includes a plurality of flutes 150 defined in the body 132. Herein, the flutes 150 are in the form of channels defined in the body 132, extending from the top portion 134 to the bottom portion 136 thereof. Each of the plurality of flutes 150 provides a continuous channel to allow for flow of the fluid therein. As discussed, the inlet port 140 in the heat dissipating element 130 is provided at the top portion 134 thereof and is in fluid communication with the first collector pipe 116 to receive the fluid therefrom. Herein, the received fluid from the first collector pipe 116 via the inlet port 140 is passed to the flow inside the flutes 150 in the heat dissipating element 130. The received fluid flows in each of the flutes 150 in the heat dissipating element 130, from the top portion 134, passing through the middle portion 138 and then to the bottom portion 136 in the body 132. Further, as discussed, the outlet port 142 in the heat dissipating element 130 is provided at the bottom portion 136 thereof and is in fluid communication with the second collector pipe 118 to supply the collected fluid thereto. Herein, the fluid coming from the top portion 134 and the middle portion 138 to the bottom portion 136 in the body 132 is passed via the outlet port 142 of the heat dissipating element 130 to the second collector pipe 118.

Now, as shown, the plurality of flutes 150 are extending across a longitudinal length of the body 132 in the heat dissipating element 130. Further, the plurality of flutes 150 are distributed across a lateral length of the body 132 in the heat dissipating element 130. In an example, the plurality of flutes 150 may be distributed equidistant to each other across the lateral length of the body 132; however other suitable distribution arrangement(s) may also be implemented without departing from the spirit and the scope of the present disclosure. According to embodiments of the present disclosure, one or more of the plurality of flutes 150 are extending longitudinally downwards and diverging laterally outwards from the inlet port 140 in the top portion 134 of the body 132, extending longitudinally downwards in the middle portion 138 of the body 132, and extending longitudinally downwards and converging laterally inwards towards the outlet port 142 in the bottom portion 136 of the body 132. That is, generally, each flute 150 has a diverging-converging profile, with the flutes 150 towards one of the longitudinal side (edge) from a longitudinal axis along a lateral centre of the body 132 being mirror-image to the flutes 150 towards other of the longitudinal side (edge) from the said longitudinal axis of the body 132.

Such diverging-converging profiles of the flutes 150 help to divert the oil flowing therein away from the first collector pipe 116 and the lateral centre of the body 132, and towards the flutes 150 at the lateral sides of the body 132, in the heat dissipating element 130. In other words, the diverging and converging profile of the heat dissipating element 130 allows at least some of the received oil from the first collector pipe 116 to diverge to the flutes 150 towards the lateral sides of the body 132. As may be contemplated, the surrounding temperature near middle (lateral centre) of the body 132 would be more compared to the lateral sides of the body 132, in the heat dissipating element 130. Thus, the flutes 150 towards the lateral sides of the body 132 get higher free flow of fresh air. This allows the oil present in such flutes 150 towards the lateral sides of the body 132 to cool the oil therein more quickly because of more contact with the atmospheric air. This creates a thermographic profile of parabolic in shape for the heat dissipating element 130 (as discussed later in detail).

The diverging-converging profiles of the flutes 150 may provide higher hydraulic dimensions for the flutes 150, thus helping with better flow of the oil therein. As used herein, the "hydraulic dimension" refers to characteristic length used to calculate the dimensionless number to determine if the flow is laminar or turbulent. In general, the hydraulic dimension represents an effective cross sectional area of the flute 150 which contributes for the oil to flow through. Thereby, the heat dissipating element 130 enables to allow for flow of high-viscosity fluid therein, which may not be possible with traditional designs. In the present embodiments, the fluid used in the transformer device 100 to be cooled by the heat dissipating elements 130 of the radiator 110 comprises ester oil. The ester oil is highly viscous oil, but may help with better heat dissipation and is also biodegradable. This is in contrast to mineral oils which are used in traditional set-ups because of their limitations to handle high-viscosity fluids, and which are also non-biodegradable thus posing harm to the environment when disposed. It may also be appreciated that the diverging profiles of the flutes 150 at the top portion 134 may also help to distribute the oil as received more uniformly between the multiple flutes 150 as compared to, say, traditional tubular design in which the oil is distributed from a top tank and usually the channels towards the centre may receive more flow of oil as compared to the channels towards the lateral sides, which is undesirable.

As may be seen, the body 132 of the heat dissipating element 130 is made of sheet materials with the flutes 150 defined therein (as discussed later in more detail). Thus, the body 132 of the heat dissipating element 130 provides a significantly larger surface area as compared to, say, traditional tubular design which has individual distant tubes therein. Thus, in the present heat dissipating element 130, the body 132 may also contribute towards dissipation of heat from the oil flowing in the flutes 150 to the atmospheric air. In fact, the larger surface area of the body 132 may allow to provide significantly more heat transfer, thus contributing to the thermal performance of the heat dissipating element 130. Also, in the present embodiments, the body 132 of each heat dissipating element 130 is made of steel (as discussed later in more detail). Therefore, it may be possible to have as much as up to 50 heat dissipating elements 130 in the single radiator 110 with the present design, which is not possible with traditional designs. Further, in an embodiment, a sheet surface (as marked by reference numeral 152) between the plurality of flutes 150, i.e., the area between the flutes 150 of the body 132, is corrugated. As may be understood by a person skilled in the art, such corrugated profile of the sheet surface 152 may further enhance the heat transfer from the body 132, improving overall thermal performance of the heat dissipating element 130.

Figure 4:
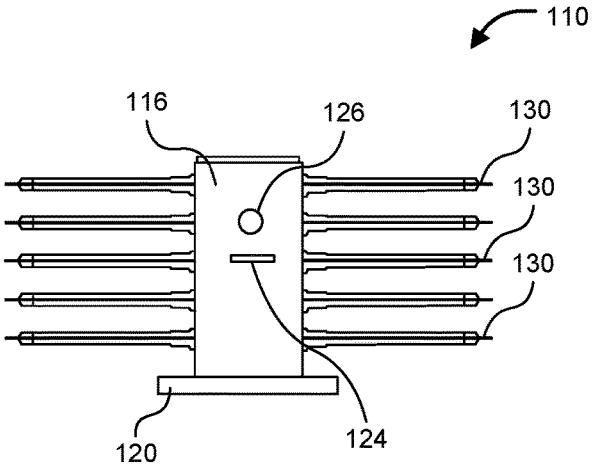
FIG. 4 illustrates a diagrammatic top planar view of the radiator, in accordance with one or more exemplary embodiments of the present disclosure.
Figure 5:
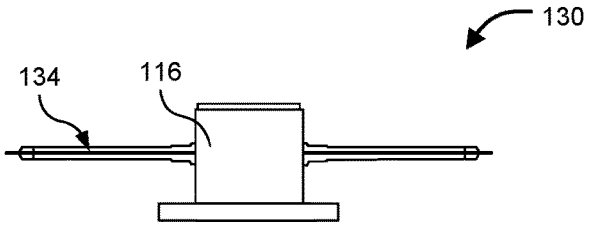
FIG. 5 illustrates a diagrammatic top planar view of the heat dissipating element of the radiator, in accordance with one or more exemplary embodiments of the present disclosure.

Referring to FIG. 4, illustrated is a top view of the radiator 110 showing the heat dissipating elements 130 therein. As discussed, in the illustrated embodiments, the radiator 110 is shown to include five (5) number of heat dissipating elements 130. It may be contemplated that the radiator 110 may include from 1 up to 45 number of heat dissipating elements 130 therein, depending on the rating, and thus heating load, of the transformer device 100. FIG. 5 illustrates a top view of the heat dissipating element 130. As shown, the heat dissipating element 130 is connected to the first collector pipe 116 (and similarly to the second collector pipe 118) at the lateral centre thereof. In general, selection of the number of radiators 110 depends on rating of the transformer device 100. There are different types and rating of the transformer device 100 which requires each of the radiators 110 to include the heat dissipating elements 130 to be as low as just 2 panels and up to 45 panels, and with length of each of the heat dissipating elements 130 starting from 500 mm up to 4500 mm. This is in contrast to traditional designs in which there are many limitations in the selection of number of tubes and length of the tubes for a radiator and its structural integrity as a product. In the present embodiments, the size and the number of heat dissipating elements 130 in the radiator 110 is not particularly limited and depends only on its intended use for the transformer device 100 to be cooled.

Figure 6:
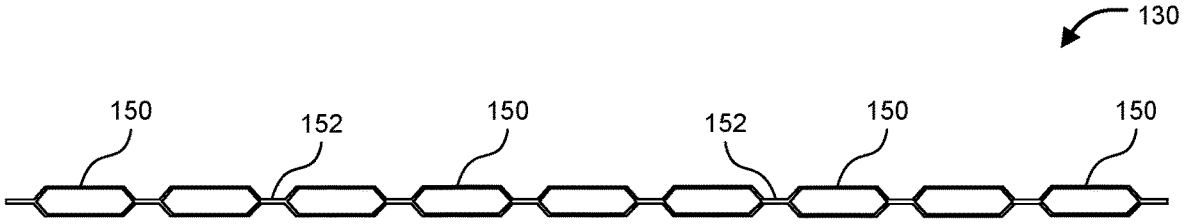
FIG. 6 illustrates a diagrammatic cross-section view of the heat dissipating element of the radiator, in accordance with one or more exemplary embodiments of the present disclosure.
Figure 7:
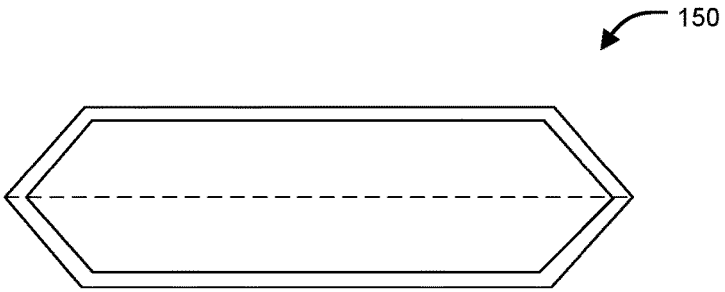
FIG. 7 illustrates a diagrammatic cross-section view of a single flute of the heat dissipating element of the radiator, in accordance with one or more exemplary embodiments of the present disclosure.

FIG. 6 illustrates a cross-section view of the heat dissipating element 130 showing in detail the individual flutes 150 therein. In the present exemplary embodiment, the heat dissipating element 130 includes nine number of flutes 150. That is, the plurality of flutes 150 includes nine number of flutes 150. It may be appreciated that the said number of flutes 150 is a preferred embodiment, and is not limiting to the present disclosure. As shown, a cross-section of each one of the plurality of flutes 150 is in the form of two trapeziums mirrored to each other along bases thereof. FIG. 7 illustrates a detailed section view of the individual flute 150. It may be seen that the flute 150 has a hexagonal profile, particularly formed of two trapeziums mirrored to each other along bases (as represented by dashed line) thereof. Such profile may help with better flow of the fluid inside the flute 150, thus improving the thermal performance of the heat dissipating element 130, and thereby the overall radiator 110. In general, the better cooling efficiency is achieved with optimum oil channel spacing due to the distribution and the diverging-converging profiles of the flutes 150, allowing the high viscous oil, such as ester oil (with viscosity about 3.5-5 times more than mineral oil), to flow smoothly. Thus, even the transformer device 100 with large rating/capacity, requiring large amount of heat dissipation, may be cooled using the radiators 110 of the present disclosure.

Figure 8:
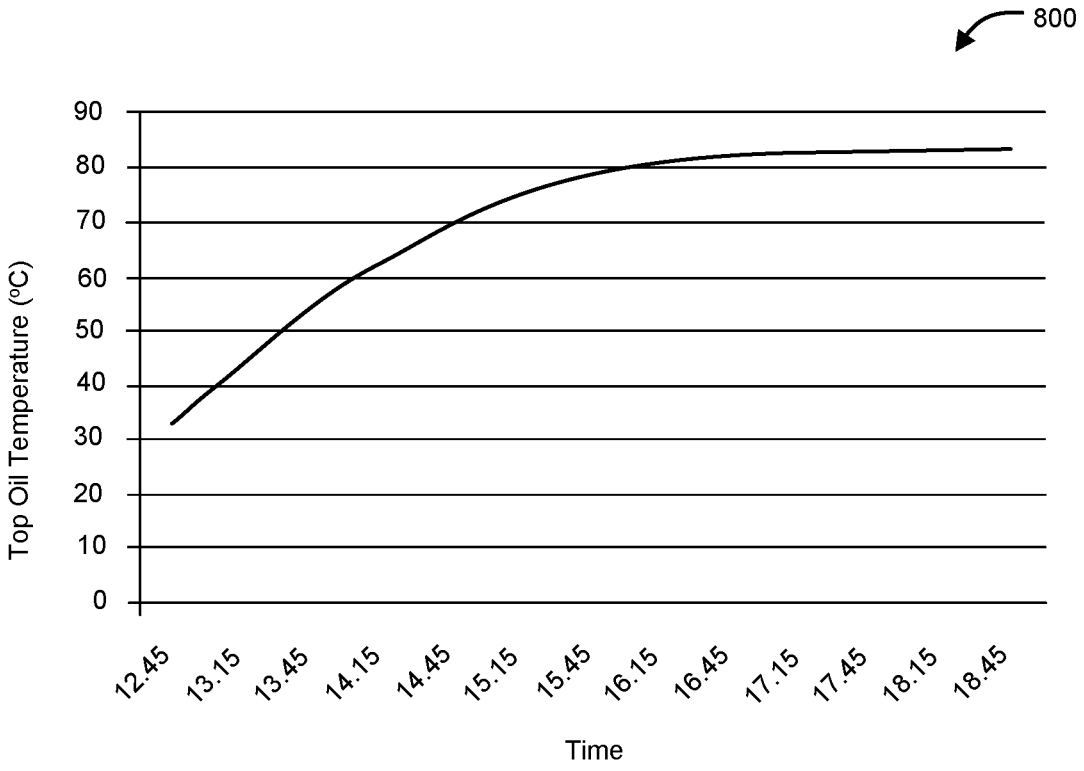
FIG. 8 illustrates an exemplary graph indicative of temperature rise of oil with time in the radiator, in accordance with one or more exemplary embodiments of the present disclosure.

Referring to FIG. 8, illustrated is an exemplary graph 800 indicative of temperature rise of oil with time in the radiator 110, in accordance with one or more exemplary embodiments of the present disclosure. As shown in the graph 800, the top oil temperature in the radiator 110 for ester oil rises faster and stabilizes earlier (as compared to mineral oil in the traditional designs) and the difference between measured top oil and bottom oil temperature for the radiator 110 shows a better temperature drop. This is achieved because of the optimum oil flow in the flutes 150, which helps in reducing the frictional losses, thus speed of flow of fluid remain optimum and thus the heat dissipating elements 130 in the radiator 110 dissipate more heat, which advantageously affects the overall cooling capacity of the radiator 110 for use with the transformer device 100.

Figure 9:
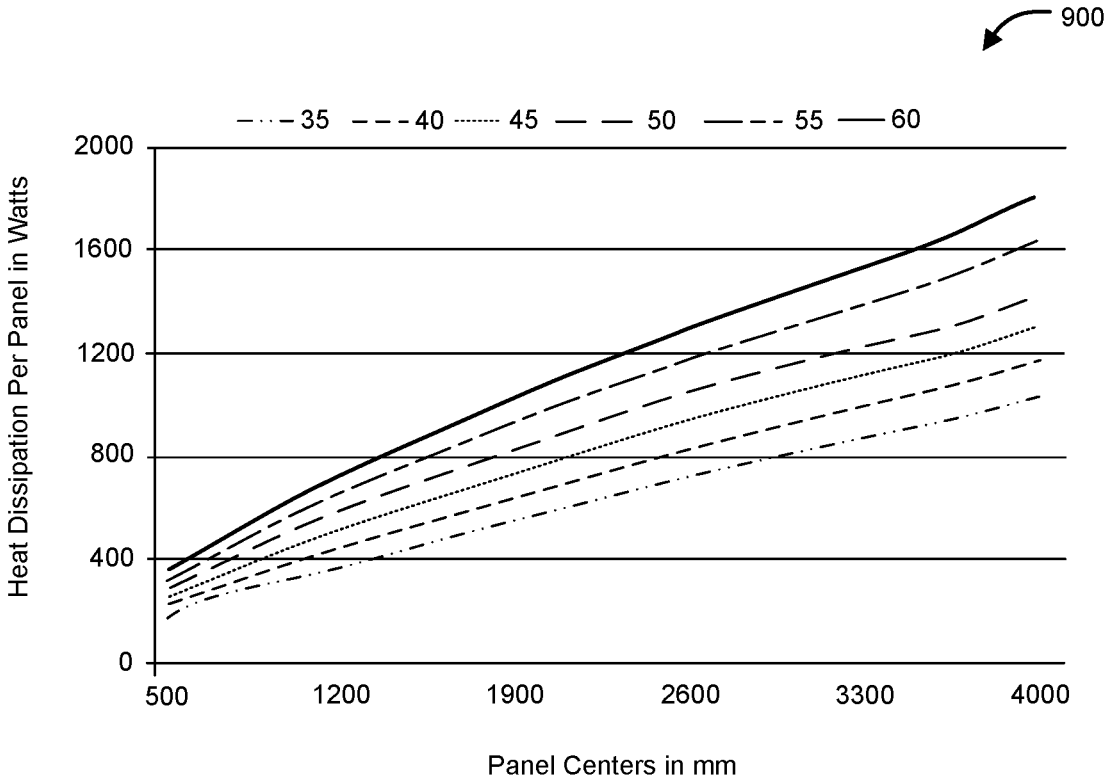
FIG. 9 illustrates an exemplary graph indicative of rate of heat dissipation from the heat dissipating element of the radiator across lateral length thereof for different ambient temperature conditions, in accordance with one or more exemplary embodiments of the present disclosure.

Referring to FIG. 9, illustrated is an exemplary graph 900 indicative of rate of heat dissipation from the heat dissipating element 130 of the radiator 110 across lateral length thereof for different ambient temperature conditions, in accordance with one or more exemplary embodiments of the present disclosure. In testing using thermal imaging apparatus, it was confirmed that the oil was cooled quickly at the outer flutes 150 (i.e., the flutes 150 towards the lateral sides) as compared to the flutes 150 at the lateral centre of the body 132 of the heat dissipating element 130. As explained in the preceding paragraphs, this is due to more exposure to the ambient air for the outer flutes 150 as compared to the flutes 150 at the lateral centre of the body 132 of the heat dissipating element 130. This is confirmed in the graph 900, as shown, the heat dissipation increases as the distance from the centre of the body 132 of the heat dissipating element 130 increases.

Figure 10:
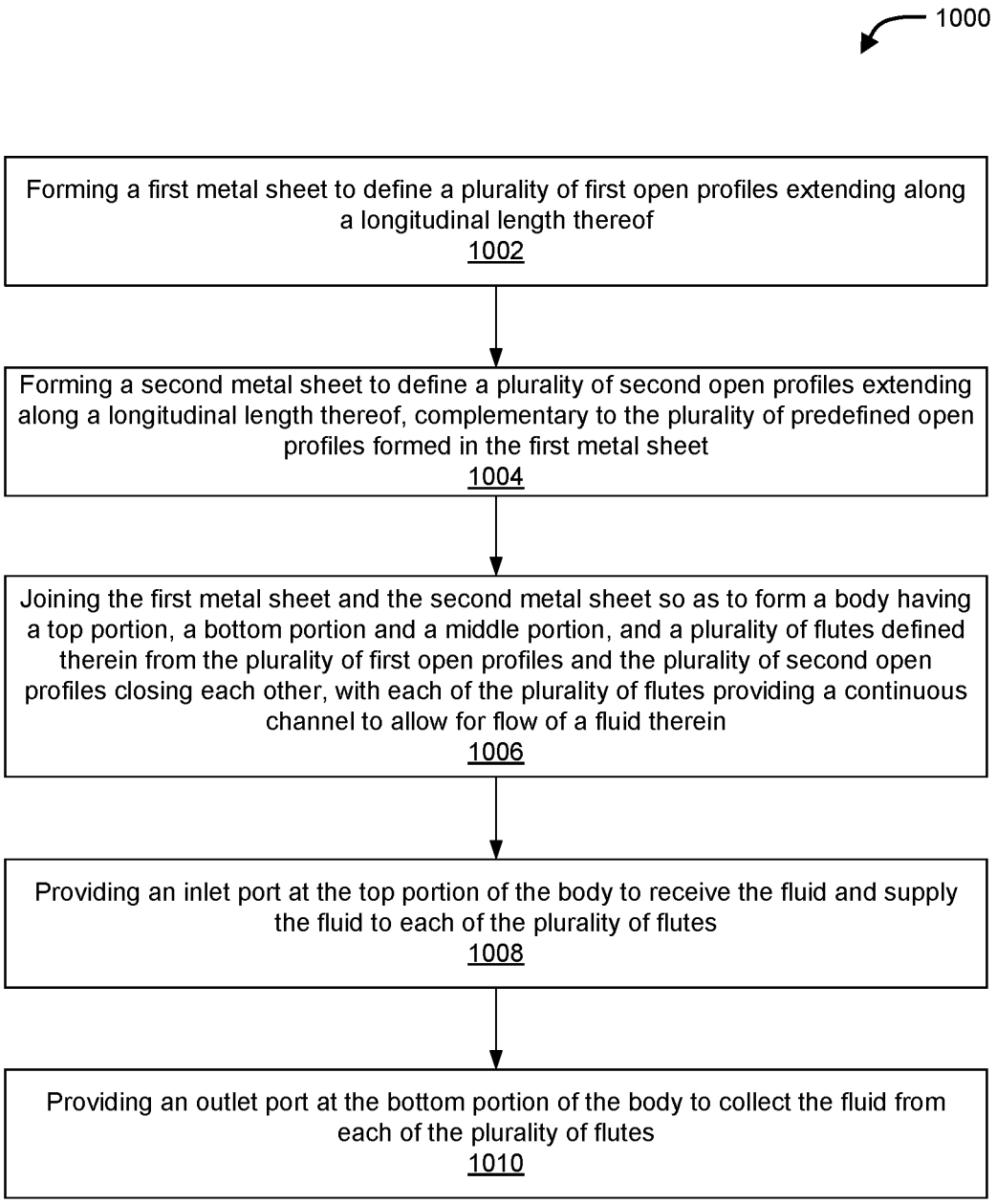
FIG. 10 illustrates a flowchart listing steps involved in a method of manufacturing a heat dissipating element for a radiator, in accordance with one or more exemplary embodiments of the present disclosure.

The present disclosure further provides a method of manufacturing a heat dissipating element (such as, the heat dissipating element 130) for a radiator (such as, the radiator 110). FIG. 10 illustrates a flow chart listing steps involved in the present method (represented by reference numeral 1000) of manufacturing the heat dissipating element 130 for the radiator 110. It may be appreciated that the teachings as described above, may apply mutatis mutandis to the method as described herein below.

At step 1002, the method 1000 includes forming a first metal sheet to define a plurality of first open profiles extending along a longitudinal length thereof. Herein, the first metal sheet may be made of steel. Specifically, the first metal sheet may be made of steel material with high formability, such as one of: CRCA IS 513 CR2 grade steel, CRCA IS 513 CR3 grade steel, CRCA IS 513 CR5 grade steel grade steel, and austenitic stainless grade steel. Each of the plurality of first open profiles is in the form of a trapezium opened at base thereof (as shown in reference to FIG. 7). The plurality of first open profiles are formed in the first metal sheet using one or more of: rolling operation, stamping operation. In particular, each of the plurality of first open profiles has a diverging section, a straight section, and a converging section. The said diverging section and converging section of the first open profiles may be formed by stamping operation, whereas the straight section may be formed by rolling operation. At step 1004, the method 1000 includes forming a second metal sheet to define a plurality of second open profiles extending along a longitudinal length thereof. Herein, the second metal sheet may be made of steel. Specifically, the second metal sheet may be made of steel material with high formability, such as one of: CRCA IS 513 CR2 grade steel, CRCA IS 513 CR3 grade steel, CRCA IS 513 CR5 grade steel grade steel, and austenitic stainless grade steel (similar to the first metal sheet). Each of the plurality of second open profiles is in the form of a trapezium opened at base thereof (as shown in reference to FIG. 7). The plurality of second open profiles are formed in the second metal sheet using one or more of: rolling operation, stamping operation. In particular, each of the plurality of second open profiles has a diverging section, a straight section, and a converging section (complementary to the defined sections in the first metal sheet). The said diverging section and converging section of the second open profiles may be formed by stamping operation, whereas the straight section may be formed by rolling operation.

At step 1006, the method 1000 includes joining the first metal sheet and the second metal sheet so as to form a body (such as, the body 132) having a top portion (such as, the top portion 134), a bottom portion (such as, the bottom portion 136) and a middle portion (such as, the middle portion 138), and a plurality of flutes (such as, the plurality of flutes 150) defined therein from the plurality of first open profiles and the plurality of second open profiles closing each other, with each of the plurality of flutes 150 providing a continuous channel to allow for flow of a fluid therein. It may be appreciated that because of the complementary defined diverging sections, the straight sections and the converging sections in the first metal sheet and the second metal sheet, when the two sheets are joined, the plurality of flutes 150 are formed with the diverging-converging profiles. Further, because of each of the plurality of first open profiles and each of the plurality of second open profiles being in form of a trapezium opened at base thereof, a cross-section of each one of the plurality of flutes 150 is in the form of two trapeziums mirrored to each other along the bases thereof. In the present embodiments, the two sheets may be joined by multi-spot resistance welding technique, as may be performed by automated robots or the like. Further, in some examples, neck trimming technology may be implemented to eliminate non-uniform welding of the two sheets by using loop welding methodology.

At step 1008, the method 1000 includes providing an inlet port (such as, the inlet port 140) at the top portion 134 of the body 132 to receive the fluid and supply the fluid to each of the plurality of flutes 150. The said inlet port 140 is disposed in fluid communication with the first collector pipe 116 to receive the fluid therefrom, and to supply the fluid to each of the plurality of flutes 150. At step 1010, the method 1000 includes providing an outlet port (such as, the outlet port 142) at the bottom portion 136 of the body 132 to collect the fluid from each of the plurality of flutes 150. The said outlet port 142 is disposed in fluid communication with the second collector pipe 118 to supply the collected fluid thereto. Herein, the first collector pipe 116 and the second collector pipe 118 may be made of mild steel, and the heat dissipating element(s) 130 may be welded therewith for forming such connections. The present disclosure provides optimum hydraulic dimensions for the oil channels provided by the flutes 150, increasing thermosyphon effect of cooling (i.e., Oil Natural Air Natural (ONAN) cooling) because of less frictional resistance compared to traditional designs. The present disclosure further solves the problem of the transformer industry switching to ester-based oils (because of their bio-degradability) by allowing use of high-viscosity fluids in the radiator 110.

Thus, the method 1000 of the present disclosure provides the radiator 110 with the heat dissipating elements 130 in which one or more of the plurality of flutes 150 are extending longitudinally downwards and diverging laterally outwards from the inlet port 140 in the top portion 134 of the body 132, extending longitudinally downwards in the middle portion 138 of the body 132, and extending longitudinally downwards and converging laterally inwards towards the outlet port 142 in the bottom portion 136 of the body 132. This design of the radiators 110 is unique with stamped plate, and with a divergent and convergent pattern for diverting the oils away from the first collector pipe 116. This helps the oil from the first collector pipe 116 to travel away from the lateral centre of the body 132, helping the oil at the end flutes 150 to cool quickly before being supplied to the second collector pipe 118 to be used for cooling of the transformer device 100, creating a thermographic profile of parabolic in shape. In some examples, the radiator 110 as formed may be galvanized by hot dip technique to increase the life thereof. In some examples, the radiator 110 as formed is coated with duplex coating system (HDG+Paint) to provides better edge protection, excellent corrosion resistance, to serve for long periods with minimum maintenance at site.

In traditional designs of the radiators, for high viscous oil if the hydraulic dimension of the channels is small, the frictional forces are more. If the hydraulic dimension is large, the manufacturing of the radiator may be limited by process limitations and the transformers will endure from excess oil consumption. This becomes a major setback in the thermal performance of the radiator. The present disclosure provides the radiator(s) 110 with the heat dissipating elements 130 with channels in the form of flutes 150 having shape as diverging from the inlet port 140 from the top portion 134 with the first collector pipe 116 to the middle portion 138, and converging from the middle portion 138 to the outlet port 142 at the bottom portion 136 leading to the second collector pipe 118. Such diverging-converging profile helps with the oil to be distributed evenly through all the flutes 150, and also enhances better heat dissipation through the heat dissipating elements 130. In particular, the diverging-converging profile helps in faster temperature drop from the lateral sides (edges) of the heat dissipating elements 130, showing a parabolic curve in temperature profile. The present disclosure allows the heat dissipating elements 130 to accommodate larger collector pipes 116, 118 and additional flutes 150 to carry excess oil because of higher thermal performance, thus increasing the overall cooling effect provided by the radiator(s) 110 for the transformer device 100.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

I claim:

1. A heat dissipating element for a radiator, the heat dissipating element comprising:

a body having a top portion, a bottom portion and a middle portion;

a plurality of flutes defined in the body, with each of the plurality of flutes providing a single continuous channel to allow for flow of a fluid therein;

an inlet port provided at the top portion to receive the fluid and supply the fluid to each of the plurality of flutes; and an outlet port provided at the bottom portion to collect the fluid from each of the plurality of flutes, wherein a cross-section of each one of the plurality of flutes has a hexagonal profile, formed of two trapeziums mirrored to each other along bases thereof; and wherein each of the plurality of flutes extend longitudinally downwards and diverge laterally outwards from the inlet port in the top portion of the body, extend longitudinally downwards in the middle portion of the body, and extend longitudinally downwards and converge laterally inwards towards the outlet port in the bottom portion of the body, wherein the cross-section of each flute is constant along an entire longitudinal length of the flute from the inlet port to the outlet port.

2. The heat dissipating element as claimed in claim 1, wherein a sheet surface of the body between the plurality of flutes is corrugated.

3. The heat dissipating element as claimed in claim 1, wherein the plurality of flutes comprises nine flutes.

4. The heat dissipating element as claimed in claim 1, wherein the fluid comprises ester oil.

5. A radiator for cooling a device, the device having a fluid flowing therethrough to extract heat therefrom, the radiator comprising:

a first collector pipe for connection with the device to be cooled to receive the fluid therefrom;

a second collector pipe for connection with the device to be cooled to supply back the fluid thereto; and one or more heat dissipating elements, wherein each of the one or more heat dissipating elements comprises:

a body having a top portion, a bottom portion and a middle portion;

a plurality of flutes defined in the body, with each of the plurality of flutes providing a single continuous channel to allow for flow of the fluid therein;

an inlet port provided at the top portion in fluid communication with the first collector pipe to receive the fluid therefrom, and to supply the fluid to each of the plurality of flutes; and an outlet port provided at the bottom portion to collect the fluid from each of the plurality of flutes, and in fluid communication with the second collector pipe to supply the collected fluid thereto, wherein a cross-section of each one of the plurality of flutes has a hexagonal profile, formed of two trapeziums mirrored to each other along bases thereof; and wherein each of the plurality of flutes extend longitudinally downwards and diverge laterally outwards from the inlet port in the top portion of the body, extend longitudinally downwards in the middle portion of the body, and extend longitudinally downwards and converge laterally inwards towards the outlet port in the bottom portion of the body, wherein the cross-section of each flute is constant along an entire longitudinal length of the flute from the inlet port to the outlet port.

6. The radiator as claimed in claim 5, wherein a longitudinal length of each of the one or more heat dissipating elements is in a range of 500 mm up to 4500 mm.

7. The radiator as claimed in claim 5, wherein a number of the one or more heat dissipating elements varies from 1 to 45.

8. The radiator as claimed in claim 5, wherein a sheet surface of the body between the plurality of flutes is corrugated.

9. The radiator as claimed in claim 5, wherein the fluid comprises ester oil.

10. A method of manufacturing a heat dissipating element for a radiator, the method comprising:

forming a first metal sheet to define a plurality of first open profiles extending along a longitudinal length thereof;

forming a second metal sheet to define a plurality of second open profiles extending along a longitudinal length thereof, complementary to the plurality of predefined open profiles formed in the first metal sheet;

joining the first metal sheet and the second metal sheet so as to form a body having a top portion, a bottom portion and a middle portion, and a plurality of flutes defined therein from the plurality of first open profiles and the plurality of second open profiles closing each other, with each of the plurality of flutes providing a single continuous channel to allow for flow of a fluid therein;

providing an inlet port at the top portion of the body to receive the fluid and supply the fluid to each of the plurality of flutes; and providing an outlet port at the bottom portion of the body to collect the fluid from each of the plurality of flutes, wherein each of the plurality of first open profiles and each of the plurality of second open profiles is in form of a trapezium opened at base thereof, and wherein a cross-section of each one of the plurality of flutes is in the form of two trapeziums mirrored to each other along the bases thereof; and wherein each of the plurality of flutes extend longitudinally downwards and diverge laterally outwards from the inlet port in the top portion of the body, extend longitudinally downwards in the middle portion of the body, and extend longitudinally downwards and converge laterally inwards towards the outlet port in the bottom portion of the body, wherein the cross-section of each flute is constant along an entire longitudinal length of the flute from the inlet port to the outlet port.

11. The method as claimed in claim 10, wherein each of the plurality of first open profiles and each of the plurality of second open profiles is in form of a trapezium opened at base thereof, and wherein a cross-section of each one of the plurality of flutes is in the form of two trapeziums mirrored to each other along the bases thereof.

12. The method as claimed in claim 10, wherein the plurality of first open profiles and the plurality of second open profiles are formed in the first metal sheet and the second metal sheet, respectively, using one or more of: rolling operation, stamping operation.

13. The method as claimed in claim 10, wherein the first metal sheet and the second metal sheet is made of at least one CRCA IS 513 CR2 grade steel, CRCA IS 513 CR3 grade steel, CRCA IS 513 CR5 grade steel, and austenitic stainless grade steel.

* * * * *